US008772677B2

(12) United States Patent
Suzuki et al.

(10) Patent No.: US 8,772,677 B2
(45) Date of Patent: Jul. 8, 2014

(54) GLOW PLUG AND METHOD OF MANUFACTURING THE SAME

(75) Inventors: Hiroyuki Suzuki, Kasugai (JP); Shinya Murakoshi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 317 days.

(21) Appl. No.: 13/232,772

(22) Filed: Sep. 14, 2011

(65) Prior Publication Data

US 2012/0067863 A1 Mar. 22, 2012

(30) Foreign Application Priority Data

Sep. 16, 2010 (JP) ..... 2010-207959
Sep. 5, 2011 (JP) ..... 2011-193049

(51) Int. Cl.
*F23Q 7/22* (2006.01)
*H05B 3/00* (2006.01)

(52) U.S. Cl.
USPC ..... 219/270; 219/269; 219/260; 123/145 A; 361/264; 29/611

(58) Field of Classification Search
USPC ..... 219/270, 260–269; 123/145 A, 145 R; 361/264–266; 29/611
See application file for complete search history.

(56) References Cited

U.S. PATENT DOCUMENTS

2002/0162834 A1 11/2002 Asano et al.

FOREIGN PATENT DOCUMENTS

JP 9-300028 A 11/1997
JP 2002-260827 A 9/2002

*Primary Examiner* — Shawntina Fuqua
(74) *Attorney, Agent, or Firm* — Sughrue Mion, PLLC

(57) ABSTRACT

A configuration in which fixing is performed by inserting a rear end of a lead shaft member into an attachment hole of an external terminal at the rear of a glow plug and crimping an outer peripheral face of the external terminal. The outer peripheral face of a crimp formation region (78) of the external terminal (70) having a polygonal cross section is formed into a crimped portion (79) provided by round crimping toward a circle, and the external terminal (70) is fixed to the rear end (55) of the lead shaft member (50). Due to the configuration obtained from the round crimping of the polygon, plating breaks and the like are not easily produced in the plating layer on the surface of the external terminal.

6 Claims, 10 Drawing Sheets

GLOW PLUG AND METHOD OF MANUFACTURING THE SAME

TECHNICAL FIELD

The present invention relates to a glow plug mounted in a combustion chamber of an engine or the like for promoting start of a diesel engine or the like, and a manufacturing method thereof.

RELATED ART

Glow plugs of various structures have conventionally been known (see, for example, Patent Documents 1 and 2). FIG. 10 shows an example thereof. In a glow plug 801 shown, a heater element 11 which generates heat upon supply of electric current thereto is fixed to protrude from a leading end of a body (hereinafter also referred to simply as a body) 31 formed in a cylindrical shape. One of electrodes provided for the heater element 11 is formed to be grounded to an engine head (not shown) through the body 31 or the like, and the other is electrically connected to a metallic lead shaft member 51 of a rod shape positioned to hold electrical insulation within the body 31 at the rear of the heater element 11. To a rear end of the lead shaft member (hereinafter also referred to simply as a shaft member) 51, an external terminal (pin terminal) 70 is fixed to protrude from a rear end of the body 31 for connection to a socket terminal of a lead for power supply.

Such an external terminal 70 has an opening attachment hole 72 at the center of a leading end. In a final step of an assembly process of the glow plug, a rear end 55 of the lead shaft member 51 is inserted into the attachment hole 72, and then a portion (crimp formation region) of an outer peripheral face around the attachment hole 72 in a front-back direction is crimped to provide a crimped portion 80 with its cross section of the outer peripheral face changed from circle to polygon (for example, a generally square shape shown in an enlarged view of FIG. 10) to fix the portion to the shaft member 51. In the following description, the leading end of a glow plug 101 and that of other respective components (parts) constituting the glow plug 101, such as the external terminal 70, are referred to as the lower end of the glow plug 801 or the like in FIG. 10, whereas the rear end is referred to as the upper end in FIG. 10.

The external terminal (terminal member) 70 as described above is made of, for example, a rolled steel material for general structure considering its strength and deformability. After shaping and machining thereof into parts, a plating layer (plating layer, for example of tin (Sn), nickel (Ni), or silver (Ag) plating) is typically formed on the surface in order to prevent oxidation and to facilitate electrical connection with the socket terminal. On the other hand, as shown in a left diagram of FIG. 11, the crimped portion 80 as described above is provided by using a pair of dies 551 and 561 respectively having shaping portions (shaping faces) 553 and 563 with a crimping blade forming a V shape opened at a generally 90 degrees, sandwiching the crimp formation region of the external terminal 70 of a pre-crimping workpiece (glow plug assembly), not shown, as shown in a right diagram of FIG. 11, and performing the crimping such that the cross section is changed from circle to polygon (for example, a square shape) to provide the crimped portion 80.

PRIOR ART DOCUMENTS

Patent Documents

[Patent Document 1] JP-A-2002-260827
[Patent Document 2] JP-A-09(1997)-300028

SUMMARY OF THE INVENTION

Problems to be Solved by the Invention

When the external terminal 70 is sandwiched and the crimp formation region is crimped (hereinafter also referred to as "square crimping") such that the cross section is changed from circle to polygon, problems occur in which cracks and breaks (plating breaks) or peeling occur in the plating layer at the site corresponding to a corner 80*c* of the polygon of the crimped portion 80 after the crimping. Such plating breaks or peeling (plating damage) leads to oxidation (corrosion) starting from the plating damage. As this enters an advanced stage, faulty electrical continuity may result with the terminal of the counterpart (the socket terminal of the lead) covering the external terminal 70 in the process of use as the glow plug, presenting the problem in electrical reliability. Such plating breaks or peeling occurs as follows. When the square crimping is performed as described above, the site corresponding to the corner 80*c* of the square after the crimping in the outer peripheral face of the crimped portion 80 of the external terminal 70 is subjected to high tensile stress in the crimping process along the peripheral direction in association with the deformation to cause large extensional deformation. Since the plating layer cannot follow the extensional deformation, the plating breaks and the like occur. In other words, it is contemplated that the cause of the occurrence is the action of the high tensile stress on the plating layer at the site of the corner 80*c* in the square crimping.

The lead shaft member is often made of stainless steel material (such as SUS430 and SUS410) or iron material such as carbon steel. In recent years, however, a lead shaft member made of light alloy (hereinafter also referred to as "made of aluminum") such as aluminum or aluminum alloy (alloy mainly made of aluminum) may be used in response to the need for lighter weight of the glow plug (as a whole). On the other hand, such a lead shaft member made of aluminum has a strength and rigidity lower than those made of iron material. Thus, when the external terminal is fixed to the lead shaft member made of aluminum by the crimping as described above, highly reliable fixing is difficult to achieve. Specifically, even when it is intended that the external terminal should be compressed and crimped with a large force to increase the crimping force (fixing force), the lead shaft member made of aluminum which is a low-strength material is easily deformed and rigid fixing cannot be achieved.

When the square crimping is performed as described above, the dies 551 and 561 used therefor have short lives. The reason is as follows. In the case of the square crimping, the shaping portions (shaping faces of the V shape) 553 and 563 of the dies 551 and 561 inevitably hit the external terminal 70 at substantially the same positions (see the left diagram of FIG. 11) in the early stage of the crimping (at the start of the hitting of the dies) since the crimp formation region (cross section) has the circular shape. In other words, the initial hit position in the die continues to receive the strong impact locally, so that the portion is significantly worn at the early stage to reduce the life of the dies.

The present invention has been made in view of the above-mentioned problems in the conventional glow plug. It is an object thereof to provide a glow plug in which, when an external terminal is fixed to the rear end of a shaft member by crimping as described above, no damage occurs such as plating breaks or peeing in a plating layer formed on the surface of the external terminal, and even when the lead shaft member is made of a low-strength material such as aluminum, reliable and rigid fixing can be achieved to the external terminal, and the life of a die for use in the crimping process is increased, and a manufacturing method of the glow plug.

Means for Solving the Problems

According to claim 1, the present invention provides a glow plug having a configuration in which a heater element generating heat upon supply of electric current thereto is positioned frontward or at a leading end of a tubular body, one of electrodes of the heater element is electrically connected to a metallic lead shaft member positioned inside the body and rearward with respect to the heater element, a rear end of the lead shaft member is inserted into an attachment hole opened at a leading end side of an external terminal having a plating layer thereon, and the external terminal is crimped to be fixed to the rear end of the lead shaft member, characterized in that an outer peripheral face of the external terminal in cross section is shaped into a form close to a circle from a polygon shaped before crimping, whereby the external terminal is fixed to the rear end of the lead shaft member.

The "polygon" in the present invention covers a broad concept including not only a regular polygon in mathematics and geometry and a polygon although not a regular polygon, but also a shape including linear or curved sides and having plural corners and a shape having rounded corners provided with inclined chamfering (or round chamfering).

According to claim 2, the present invention provides a method of manufacturing a glow plug having a configuration in which a heater element generating heat upon supply of electric current thereto is positioned frontward or at a leading end of a tubular body, one of electrodes of the heater element is electrically, connected to a metallic lead shaft member positioned inside the body and rearward with respect to the heater element, a rear end of the lead shaft member is inserted into an attachment hole opened at a leading end side of an external terminal, and the external terminal is fixed to the rear end of the lead shaft member, the method including a step of crimping the external terminal to fix the external terminal to the rear end of the lead shaft member after inserting the rear end of the lead shaft member into the attachment hole of the external terminal, an outer peripheral face of a crimp formation region of the external terminal before the crimping step being formed into a polygon in cross section, and characterized in that, in the crimping step, the outer peripheral face of the crimp formation region in cross section is shaped into a form close to a circle from the polygon shaped before the crimping step.

According to claim 3, the present invention provides the method of manufacturing a glow plug according to claim 2, characterized in that a die used in the crimping step is a two-part split die formed such that a shaping portion thereof defines a circular shape when the die is closed, and that the outer peripheral face of the crimp formation region of the external terminal is formed into a polygon having an odd number of corners in cross section.

According to claim 4, the present invention provides the method of manufacturing a glow plug according to claim 2 or 3, characterized in that, in the crimp formation region of the external terminal, an overlapping portion overlapping with the rear end of the lead shaft member inserted into the attachment hole in an axis line direction has a large-diameter portion having a diameter larger than other portions at the center or close to the center of the overlapping portion in a front-back direction.

According to claim 5, the present invention provides the method of manufacturing a glow plug according to any one of claims 2 to 4, characterized in that a shaping portion of a die used in the crimping step for crimping the outer peripheral face of the crimp formation region is formed to be convex toward the outer peripheral face of the crimp formation region such that the convex has a peak portion at the center or close to the center of the shaping portion in a front-back direction.

According to claim 6, the present invention provides the method of manufacturing a glow plug according to any one of claims 2 to 4, characterized in that a shaping portion of a die used in the crimping step for crimping the outer peripheral face of the crimp formation region is formed to be convex toward the outer peripheral face of the crimp formation region such that the convex has a peak portion facing the center or close to the center of an overlapping portion in the crimp formation region of the external terminal, the overlapping portion overlapping with the rear end of the lead shaft member inserted into the attachment hole of the external terminal in an axis line direction.

Effect of the Invention

In the glow plug according to the present invention, the external terminal is fixed to the rear end of the lead shaft member by crimping so that the cross section of the outer peripheral face of the crimped portion is shaped into a form close to a circle (circular shape) from a polygon shaped before the crimping step. Thus, in the present invention, the square crimping as in the conventional example is not performed but round crimping is performed in which the cross section of the outer peripheral face of the crimp formation region is changed from a polygon before the crimping step such as a square or a hexagon into a circle by crushing the corners during the crimping step. (the crimping into a circle is hereinafter referred to as the "round crimping" in order to be distinguished from the "square crimping".) In such round crimping, any high tensile stress does not act locally in a peripheral direction during the crimping step or after the crimping in contrast to the deformation of the cross section from a circle into a polygon having corners. This can prevent the plating breaks or peeling as in the conventional example, from occurring in a plating layer formed on the surface of the external terminal.

Since the present invention involves the round crimping of the cross section from the polygon into the circle to fix the external terminal to the shaft member, the original corner on the outer peripheral face is deformed to have a larger angle in the crimping step. Any tensile stress does not act on the surface of the corner in the peripheral direction, so that plating breaks or peeling in the plating layer is not produced easily as compared with the conventional square crimping. On the other hand, while tensile stress acts on a portion in the peripheral direction along the surface between the corners of the original polygon due to deformation extending in an arc shape, the deformation does not result in a corner as in the square crimping and thus any plating breaks or peeling is not produced in the plating layer. The round crimping of the external terminal whose outer peripheral face assumes a circular shape in cross section before crimping may be performed by using a die in which a shaping portion thereof has a curvature (radius) different from that of the outer peripheral face when the die is closed. In such a case, however, the area of the shaping portion in contact with the outer peripheral face is increased and the surface pressure is not easily applied, and a random cross section is produced after the crimping, thereby presenting the problem of difficulty in controlling the cross section shape after the crimping. Such a problem does not occur in the present invention since the cross section is the polygon before the crimping step.

According to the present invention, a high fixing force can be provided even when the lead shaft member is made of aluminum or aluminum alloy. Such a lead shaft member made of aluminum is easily deformed due to a lower strength and lower rigidity than the member made of iron material. Thus, when the external terminal externally fitted to the rear end of the shaft member is square shaped as in the conventional case, a high fixing force cannot be provided since the rear end of the lead shaft member made of aluminum is deformed relatively largely based on the deformability of the shaft member. Specifically, if the rear end of the shaft member is formed into a column shape and the external terminal is square crimped, the rear end of the shaft member is largely deformed such that the cross section is changed into a square in association with the square crimping. In contrast, since the external terminal is round crimped in the present invention, the cross section of the rear end of the lead shaft member is not largely deformed after the crimping as in the square crimping even when the rear end originally has a column shape. In other words, since the deformation of the cross section of the rear end of the lead shaft member can be reduced by the round crimping in the present invention as compared with the square crimping, a higher fixing force can be achieved as compared with the square crimping even when the lead shaft member is made of a low-strength material such as aluminum.

Since the present invention employs the round crimping, the die (blade for crimping) used in the crimping typically has the shaping portion (shaping internal face) forming a circle when the die is closed. However, the present invention is not limited thereto and an oval close to a circle can be used. On the other hand, the outer peripheral face of the crimp formation region of the external terminal before the crimping step has a polygonal cross section. Thus, the position of the corner hitting the shaping portion (shaping internal face) of the die during the crimping step can be controlled so as not to be the same as in the conventional example. In other words, in the present invention, the crimping can be performed such that the corners of the polygon of the outer peripheral face of the crimp formation region in the external terminal do not hit particular sites (the same positions) of the shaping portion of an arc shape of the die. As a result, it is possible to prevent early and significant wear and damage from locally occurring only at the particular sites (the same positions) in the present invention in contrast to the square crimping, so that the life of the die used in the crimping can be increased.

It is only required that the die used in the manufacturing method according to the present invention can achieve the crimping (round crimping) closer to the circle after the crimping, and the number of splitting (the number of crimping blades (nail)) of the die is not limited to two (the die formed to perform crimping through clamping in two directions). Since the present invention employs the round crimping, the two-part split die can achieve stable crimping. When the two-part split die is used, the outer peripheral face of the crimp formation region of the external terminal may be formed into the polygon (for example, a pentagon) having an odd number of corners in cross section as in the present invention according to claim 3. When the polygon is used, a polygon based on a regular polygon is typically formed, and the use of the polygon having an odd number of corners eliminates the risk of two of the corners being positioned simultaneously on the die closing face. Stable round crimping can be performed only by performing control to avoid one corner positioned on the die closing face.

Typically, the shaping portion in the die used in the crimping step (the shaping face which is the shaping portion used for the crimping in the die closing face) is formed in parallel or generally in parallel to the axis line of the lead shaft member in the front-back direction of the crimp formation region. Thus, the crimp formation region of the external terminal can be formed as described in the invention according to claim 4 to apply locally the large load to the large-diameter portion easily in the crimping step. With this effect, a larger deformation amount (compression amount) can be obtained from the crimping in the large-diameter portion than the other portions in the present invention. Since the fixing force from the crimping of the lead shaft member and the external terminal can be effectively increased locally, the stability of the electrical connection between them can be enhanced. The overlapping portion with the rear end of the lead shaft member in the axis line direction (longitudinal direction) inserted into the attachment hole in the crimp formation region of the external terminal is preferably formed to have a diameter which is (gradually) reduced from the large-diameter portion toward each end of the overlapping portion in the front-back direction. This can avoid a sudden change in the shape of the outer peripheral face of the crimp formation region of the external terminal, so that the shape is effective in avoiding problems such as plating breaks in the surface or the like. It is essential only that "the portion close to the center" in "the portion at the center or close to the center in the front-back direction" in the above invention should be any portion closer to the center than each end in the front-back direction.

The shaping portion of the die is formed as described in the present invention according to claim 5 or claim 6 to provide the similar effects to those described above. This is because that formation can provide the similar effect to those described above even when the outer peripheral face of the crimp formation region of the external terminal is parallel to the axis line of the lead shaft member inserted into the attachment hole. Specifically, the formation of the shaping portion to be convex as in the present invention causes the internal diameter in the shaping portion when the die is closed (the shape of or close to a circle in section perpendicular to the axis line) to be a small-diameter portion having a smaller diameter than in each end side in the front-back direction at the site at the center or close to the center. Thus, the large load from the crimping can be applied locally to the portion opposite to the small-diameter portion in the crimp formation region. When the shaping portion is formed to be convex as described above, it is preferable to reduce gently the thickness from the peak portion toward each end in the front-back direction of the shaping portion (increase the internal diameter of the shaping portion when the die is closed) in order to avoid problems such as plating breaks in the outer peripheral face (surface) of the crimp formation region.

The shape and size of the shaft member in cross section may not be uniform in the longitudinal direction. In addition, the shaft member may be provided with a groove (depression portion) extending along the axis line direction (longitudinal direction) in the outer peripheral face (a rearward portion to which the external terminal is fit) or a groove around a virtual plane perpendicular to the axis line. In this case, a helical groove or screw thread may be provided on the site close to the rear end. When the screw (male screw) is provided in this manner, the attachment hole of the external terminal may be realized by the screw hole engaging with the screw, and the screw may be engaged into the hole. In the present invention, means for inserting the rear end of the lead shaft member is inserted into the attachment hole opened closer to the leading end of the external terminal includes insertion through screwing.

MODE FOR CARRYING OUT THE INVENTION

Figure 1:
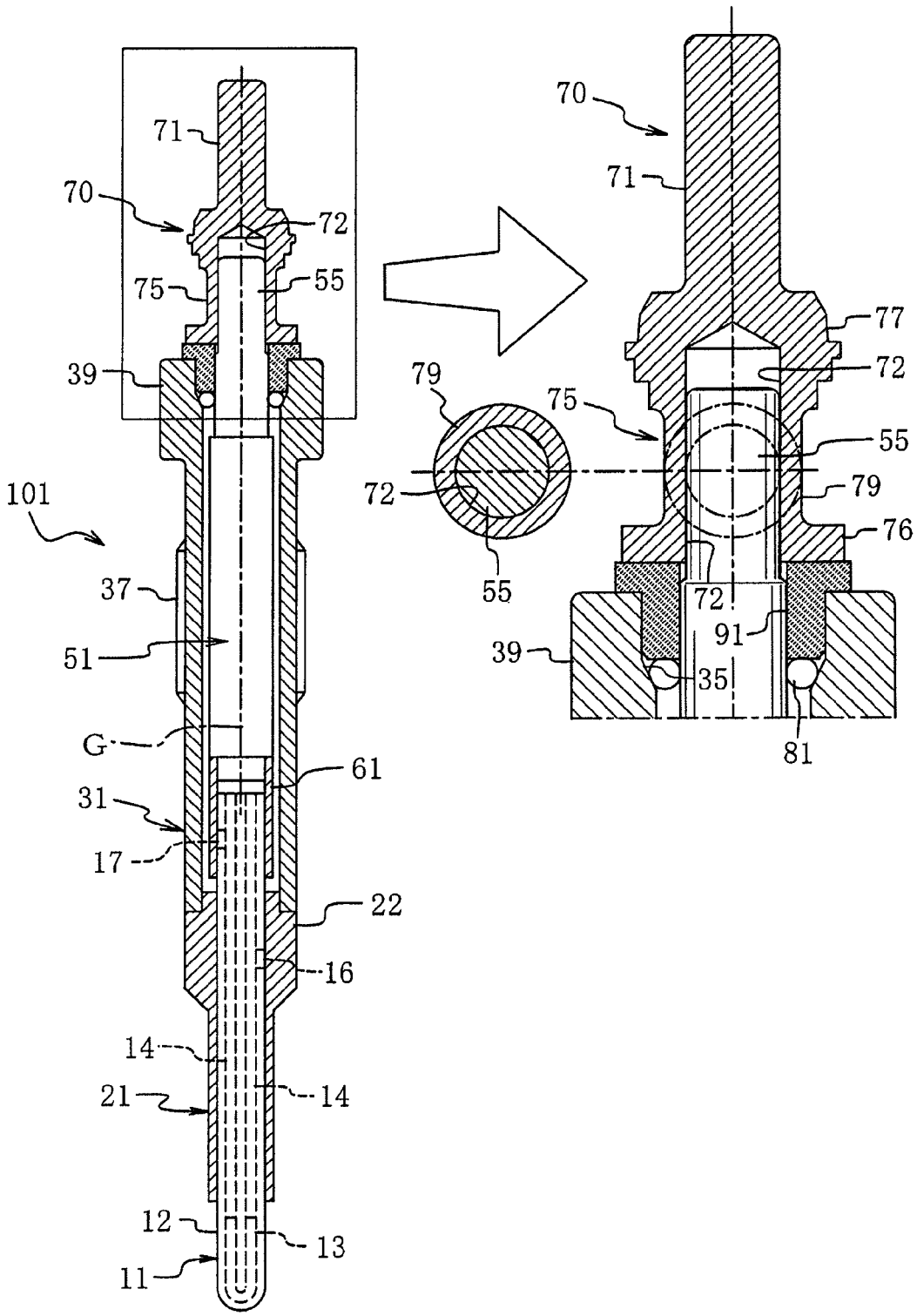
FIG. 1 is a longitudinal section view showing the front of a glow plug (finished product) according to an embodiment to which the present invention is embodied, and an enlarged view showing main portions of the present invention including an external terminal.

An embodiment in which the present invention is embodied will be described with reference to the accompanying drawings. First, the configuration of a glow plug will be described on the basis of FIG. 1. A glow plug 101 manufactured in the present embodiment is formed, as described below, of a shaft-shape ceramic heater element 11 which generates heat upon supply of electric current thereto, a metallic tubular body 21 made of stainless steel which fixes (secures) the heater element 11 such that the heater element 11 is tightly fitted therein and a leading end (lower end in FIG. 1) thereof is protruded therefrom, a cylindrical body 31 made of stainless steel attached outside and welded coaxially at the rear (upper end shown in FIG. 1) of a large-diameter portion 22 at a rear end of the tubular body 21 and the like.

Figure 2:
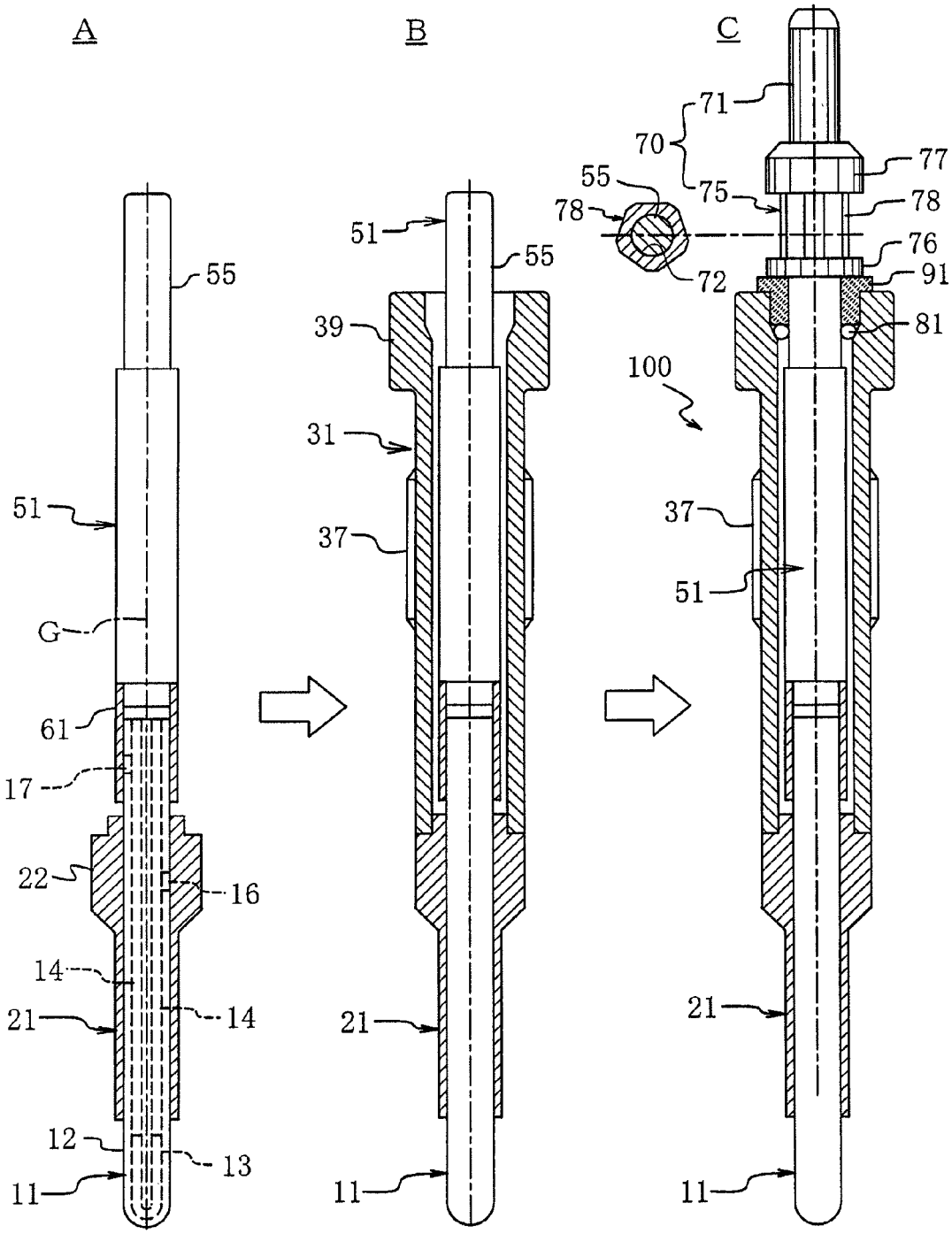
FIG. 2 is a diagram for explaining a manufacturing (assembly) step of the glow plug in FIG. 1.

Specifically, the heater element 11 is formed in a round rod shape with the same diameter in an axis line G, and electrode 16 and 17 formed in connection to relay conductors 14 extending rearward at both ends of a U-shaped resistive heat-generator 13 provided within an insulating base body (for example, silicon nitride ceramic) 12 as shown by broken lines in FIG. 1 and FIG. 2-A are exposed on the outer peripheral face (side face) at positions shifted to front and back at a rearward portion of the heater element 11. One (closer to the leading end) of the electrodes (ground-side electrode) 16 is pressed against the inner peripheral face of the metallic tubular body 21 and is electrically connected thereto. The other electrode 17 exposed at the rear is electrically connected to a leading end of a metallic lead shaft member (round rod) 51 inserted and positioned coaxially with electrical insulation from the body 31 maintained at the rear of the heat element 11. However, in the present embodiment, the leading end of the shaft member 51 is fitted into a rear end of a relay pipe 61 made of stainless steel externally fitted to the rear end of the heater element 11, and the electrode 17 at the rear is pressed against the inner peripheral face of a frontward portion of the relay pipe 61 and is electrically connected to the shaft member 51 through the relay pipe 61.

A rear end 55 of the lead shaft member 51 is protruded from a rear end of the body 31. To the protruded rear end 55, an external terminal 70 is fixed to protrude at the rear of the body 31 for connection to a socket terminal of a lead for external connection, not shown. The external terminal 70 has a tubular portion 75 having an opening attachment hole 72 of a circular cross section at the center coaxially with and closer to a leading end of a pin terminal 71 having a circular cross section closer to the rear end. The external terminal 70 is fixed to the shaft member 51 by inserting the rear end 55 of the lead shaft member 51 into the attachment hole 72 through a clearance fit and then crimping the outer peripheral face of the tubular portion 75 around the attachment hole 72.

Figure 3:
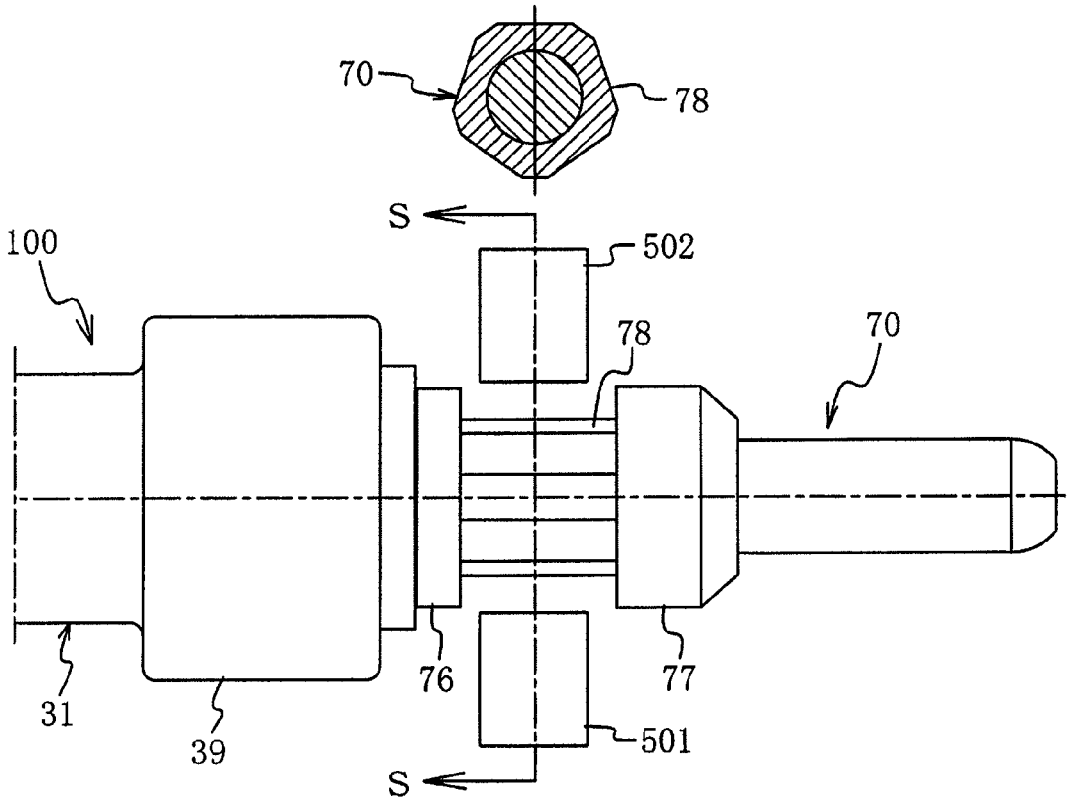
FIG. 3 is an explanatory diagram in crimping the external terminal with a die for crimping in a crimping step which is the final step of the manufacturing (assembly) of the glow plug in FIG. 1.

As shown in an enlarged view of FIG. 1, the tubular portion 75 in the external terminal 70 has a large-diameter circular flange portion 76 at a leading end and has a circular large-diameter portion 77 for preventing removal of the socket terminal (cap) at a rear end (frontward portion of the pin terminal 71). In this embodiment, the concave position thereof between the circular flange portion 76 and the circular large-diameter portion 77 for preventing removal is round crimped to provide a crimped portion 79. As shown in FIG. 2 and FIG. 3, the portion before the crimping into the crimped portion 79 has a polygonal cross section (for example, pentagon) on the outer peripheral face, and this portion serves as a crimp formation region 78 (see section views in FIG. 2 and FIG. 3). In other words, the crimped portion 79 of the external terminal 70 has a cross section close to circle after the crimping as shown in the enlarged view of FIG. 1. Such an external terminal 70 has a plating layer (for example, copper plating layer, and tin plating layer as a finishing plating layer) formed on a surface, although not shown, before the crimping, that is, in the state of the part before assembly.

An extended-diameter portion 35 is formed in the inner peripheral face of a rearward portion of the body 31, and a ring-shaped packing 81 and a ring-shaped insulating member 91 are positioned between the inner peripheral face of the extended-diameter portion 35 and the outer peripheral face of the lead shaft member 51, providing a configuration in which the shaft member 51 is fixed with insulation maintained at the rear end of the body 31. In the present embodiment, a screw portion 37 for attaching the glow plug 101 to an engine with screwing is formed on an intermediated portion of the outer peripheral face of the body 31. A polygonal portion for the screwing (for example, a hexagon-head bolt shape) 39 is provided on a rearward portion of the outer peripheral face.

Figure 4:
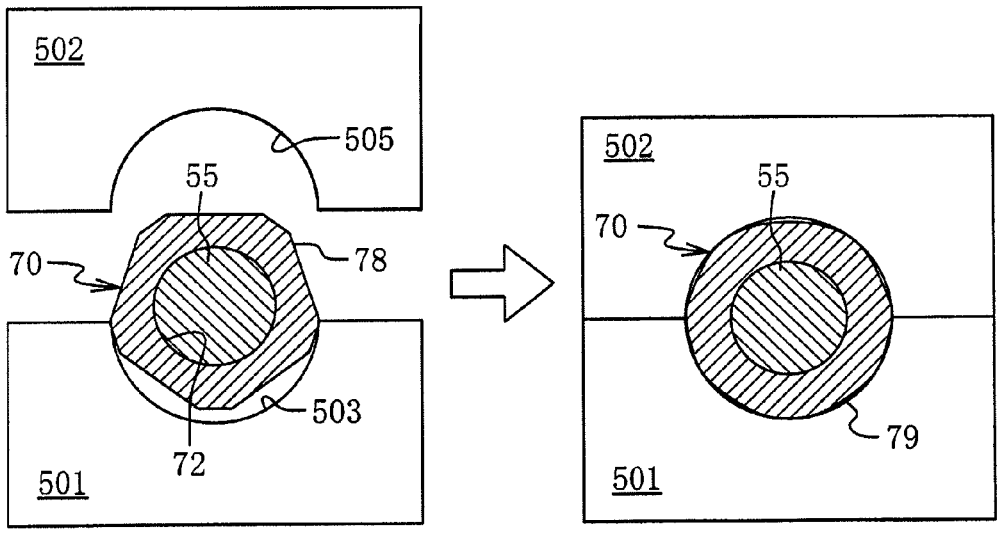
FIG. 4 is a left diagram is an enlarged view for explanation taken along S-S section in FIG. 3, and a right diagram is a diagram after a die is closed and round crimping is performed.

Next, the assembly procedure of the glow pug 101 as configured above will be described with reference to FIG. 2 to FIG. 4. As shown in a left diagram (A) of FIG. 2, the relay pipe 61 is externally fitted by pressing to the rear end of the heat element 11, the metallic tubular body 21 is externally fitted by pressing to the intermediate portion of the heater element 11, and the leading end of the shaft member 51 is press-pressed to the rear end of the relay pipe 61 to assemble an element-side intermediate (the left diagram (A) of FIG. 2). Next, as shown in a diagram (B) at the center in FIG. 2, the body 31 is externally fitted to the shaft member 51 from the rear of the element-side intermediate, the leading end of the body 31 is fitted to the rear end of the metallic tubular body 21, and the fitting portion is welded to provide a body-attached assembly. Then, as shown in a right diagram (C) of FIG. 2, the ring-shaped packing 81 and the ring-shaped insulating member 91 are fitted in order from the leading end to the rear end 55 of the shaft portion 51 protruding from the rear end of the body 31 in the assembly. Finally, the rear end 55 of the shaft member 51 is inserted into the attachment hole of the external terminal 70 having the crimp formation region 78 having the pentagonal outer peripheral face to provide a pre-crimping workpiece 100.

Next, the pre-crimping workpiece 100 is passed to the crimping process. As shown in FIG. 3 and FIG. 4, the outer peripheral face of the crimp formation region 78 in the external terminal 70 is sandwiched between two-part split (pair) dies 501 and 502 having crimping blades attached to a press apparatus (not shown) for crimping to perform pressing and crimping as shown in a right diagram of FIG. 4. Thus, the outer peripheral face of the crimp formation region 78 is round crimped from a pentagonal cross section shown in the left diagram of FIG. 4 toward a circle shown in a right diagram of FIG. 4 to provide a crimped portion 79, thereby fixing the external terminal 70 to the rear end 55 of the shaft member 51. The two-part split (pair) dies 501 and 502 as shown in FIG. 4 have, for example semicircular shaping portions 503 and 505, respectively. When the dies are closed, the shaping portions 503 and 505 compress and plastically deforms the crimp formation region 78 into the generally circular shape.

Thus, the crimping process deforms the five corners of the crimp formation region 78 having the polygonal shape (generally pentagonal shape) before the crimping in the plated external terminal 70 such that the angle of each corner is increased and the portion between the angles is extended outward (curved to be convex). The crimp formation region 78 is plastically deformed to be closer to the circle (arc) corresponding to the shaping portions 503 and 505 of the dies 501 and 502 to result in an irregular circular section. While the outer peripheral face of the crimp formation region 78 in the external terminal 70 is pentagonal before the crimping in the present embodiment, each corner of the pentagon is chamfered as shown in FIG. 3 and FIG. 4.

Since the round crimping is performed in this manner to shape the cross section of the outer peripheral face of the external terminal 70 from pentagon into a form close to a circle in the present embodiment, each corner which originally forms the pentagon is deformed to have a larger angle during the crimping process and thus any high tensile stress does not occur in the peripheral direction on the surface of the corner. This prevents plating breaks or peeling in the plating layer at those corners. Although some tensile stress acts on surfaces between the original pentagon angles in the peripheral direction, these surfaces are only deformed to extend in the arc shape. As a result, no plating breaks or peeling occurs in the plating layer.

Thus, the external terminal 70 is round crimped such that the cross section thereof is shaped into a form close to a circle from the pentagon shaped before the crimping process in the present embodiment. The occurrence of plating breaks or peeling in the surface plating layer can be reduced or prevented to avoid the corrosion or the progress of the corrosion of the external terminal 70 resulting from plating damages as in the glow plug manufactured in the conventional manufacturing method. This can enhance the reliability in electrical connection between the external terminal 70 and the socket terminal of the lead for power supply covering the terminal 70.

As understood from the pentagonal shape of the crimp formation region 78 of the external terminal 70 in the pre-crimping workpiece 100, the crimp formation region 78 can be rotated about the axis line as appropriate to perform adjustment such that the angles of the pentagon are located at arbitrary positions of the semicircular shaping portions 503 and 505 of the dies 501 and 502 when placing the crimp formation region 78 in the dies 501 and 502. Since the external terminal does not hit the shaping portions of the dies (shaping surface of the V shape) at the same positions in the early stage of the crimping (initially) as in the conventional case where the square crimping is performed to shape the cross section from the circle to the polygon such as the square, the reduction of the life of the die can be prevented.

In view of the crimping properties, strength, and cost, the external terminal 70 is made of steel material suitable for crimping of a rolled steel material for general structure or the like. On the other hand, the lead shaft member 51 may be formed by using a low-strength material such as aluminum or aluminum alloy due to the need for lighter weight or the like. When such a low-strength material is used for the shaft member, it is difficult to achieve rigid fixing simply by inserting the rear end into the attachment hole of the external terminal and crimping the outer peripheral face. In such a case, a depression or a protrusion may be provided for at least one of the inner peripheral face of the attachment hole of the external terminal and the outer peripheral face of the rear end of the shaft member such as a screw hole used as the attachment hole of the external terminal or a screw thread or a knurl formed on the outer peripheral face of the rear end of the shaft member. One of the depression and the protrusion engages with the other in crimping the external terminal, so that rigid fixing can be achieved accordingly.

Especially when the lead shaft member is formed by using a low-strength material such as aluminum or aluminum alloy, a screw may be formed on the outer peripheral face of the rear end, a screw hole engaging with the screw may be used as the attachment hole of the external terminal, the rear end (male screw) of the lead shaft member may be inserted into the screw hole, and then the external terminal may be crimped so as to crash the screw. While the present invention can obviously provide similar effects to those described above when the shaft member is inserted into the attachment hole with such screwing regardless of the material of the shaft member, the assembly work is burdensome in this case since the assembly process requires the screwing. In the present invention, however, the polygon of the crimp formation region is used to perform the engagement, so that the screwing is facilitated and performed promptly. As a result, the insertion process can be facilitated when the shaft member is made of aluminum or aluminum alloy.

It is also possible to use the lead shaft member reduced in weight by changing the material to aluminum or aluminum alloy as described above or the lead shaft member realizing lighter weight structurally by providing a depression and a protrusion on the surface of the rear end without changing the material to aluminum or the like. However, the lead shaft member realizing lighter weight structurally is generally deformed easily in response to an external force (compression force applied to the lead shaft member through the crimping process in the present invention). Thus, it can be said that such a shaft member has a low strength as a part. To address this problem, the rear end of the lead shaft member (at least the rear end deformed in the crimping process) is preferably formed in a simple column shape without providing any depression or protrusion such as the screw thread or knurl. This can reduce the probability of occurrence of damage to the lead shaft member starting from the root of the screw portion or the depression of the knurl even when the part has a low strength.

An example of how to determine whether or not the shaft member has a "low strength as a part" is a method of measuring hardness specified in the Vickers number (JIS Z2244 (1988)), for example. When this method is used to perform the measurement and the part having the measured value of HV200 or lower is used for the lead shaft member, the present invention can achieve the effects more favorably. In the present invention, the lead shaft member made of aluminum which has the Vickers number of HV110 should be used.

As described above, when the lead shaft member is made of aluminum and the external terminal is square crimped as in the conventional case, the rear end of the shaft member is also deformed in association with the square crimping to shape the cross section into square, rigid fixing cannot be achieved. In contrast, since the external terminal is round crimped in the present invention, the cross section of the rear end of the lead shaft member is not largely deformed after the crimping as in the square crimping even when the rear end originally has the column shape. Thus, even when a low-strength member such as aluminum is used for the lead shaft member, a larger fixing force can be provided as compared with the square crimping. To provide a larger fixing force, however, it is preferable to employ the screwing by providing the screw for the rear end of the shaft member and providing the screw for the attachment hole of the external terminal in addition to the crimping as described above.

Figure 5:
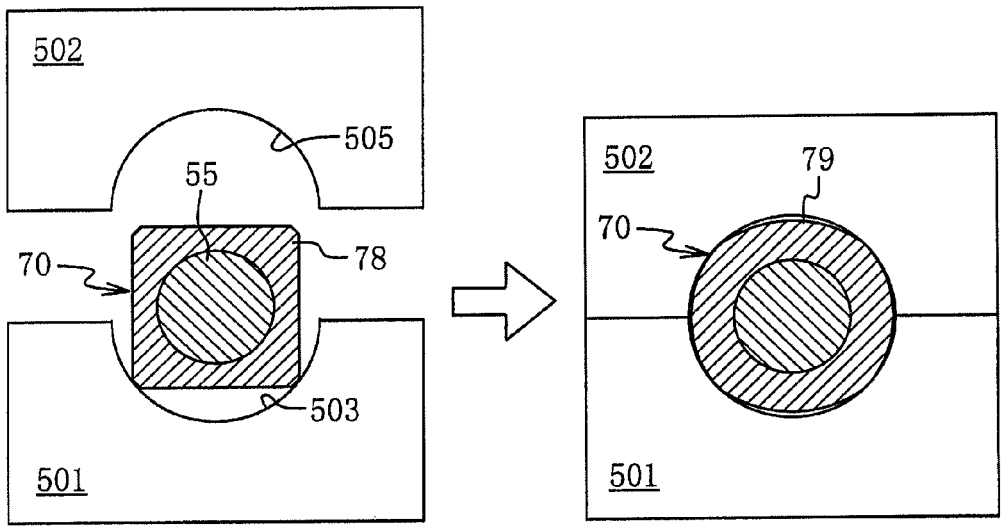
FIG. 5 is a diagram for explaining a crimping step in an external terminal when a polygon of a crimped-scheduled site is a square.

While the above embodiment has been described with the case where the two-part split dies 501 and 502 are used and the outer peripheral face of the cross section in the crimp formation region 78 of the external terminal 70 is formed as the pentagon, the polygon in the present invention is not limited to the pentagon but any polygon having an appropriate number of corners can be used. For example, when the crimp formation region 78 of the external terminal 70 has a square cross section in the outer peripheral face as shown in FIG. 5, similar two-part split dies 501 and 502 may be used to compress the crimp formation region 78 to perform round crimping as in the above example as shown in a right diagram of FIG. 5. On the other hand, when the two-part split dies 501 and 502 are used and the outer peripheral face of the cross section in the crimp formation region 78 of the external terminal 70 is formed into a polygon (regular polygon) having an odd number of corners such as a pentagon, the risk of two of the corners being positioned on both sides of the die closing face is eliminated. Since uniform round crimping can be performed simply by making adjustment such that one corner is not positioned on the die closing face, preferable round crimping can be easily achieved.

Figure 6:
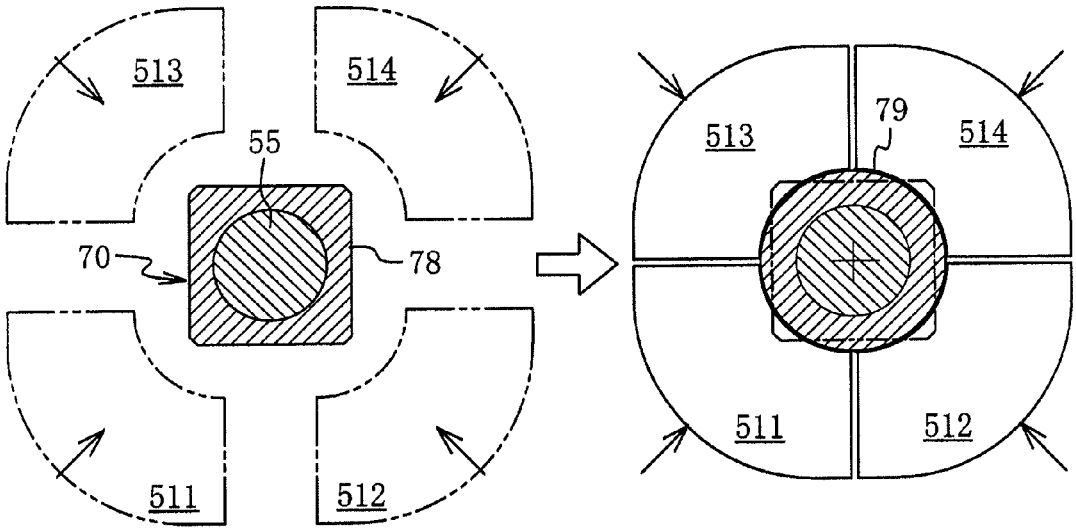
FIG. 6 is an explanatory diagram when round crimping is performed by using a four-part split die for crimping.

The die used during the crimping process in the present invention is not limited to the two-part split type. For example, as shown in FIG. 6, when the cross section of the crimp formation region 78 of the external terminal 70 has a square shape and the four corners are positioned at equal angular intervals, it is possible to use a press apparatus in which four-part split dies 511 to 514 are positioned to move radially at 90-degree intervals. When the dies 511 to 514 are moved radially for crimping in this manner, each corner thereof can be crimped and crushed effectively and uniformly to achieve the round crimping closer to circle.

Since the crimping is performed to shape the cross section of the outer peripheral face of the crimp formation region from the polygon into a form close to the circle in the present invention, the resulting circle after the crimping is more irregular as the polygon before the crimping process has a smaller number of corners regardless of the odd number or the even number of the corners. Thus, when the round crimping closer to circle is desired, it is preferable to use a polygon (pentagon to decagon) having as many corners as possible for the cross section of the crimp formation region of the external terminal. The die used for the crimping is not limited to the two-part split type, and a die split into any appropriate number may be used according to the polygon of the cross section of the crimp formation region. It is obvious in the present invention that the polygon of the crimp formation region of the external terminal is not limited to a regular polygon, and that each die is not limited to a uniformly split type.

The die used for the crimping (crimping process) is generally formed such that the shaping portion provides a circle when the die is closed regardless of the number of splitting in the present invention, it is essential only that the outer face of the crimp formation region can be crimped so that the cross section thereof is shaped into a form close to the circle from the polygon in the present invention. Thus, it is not necessary that the shaping portion provides a perfect circle when the die is closed.

Next, an embodiment which can be said as an improvement of the method of manufacturing the glow plug according to the present invention will be described with reference to FIG. 7 and FIG. 8. The present embodiment differs from the method of manufacturing the glow plug (the above manufacturing method) described with reference to FIG. 1 to FIG. 4 in the shape and the structure of the crimp formation region 78 in the external terminal 70 before crimping. Thus, description will be made only of the different points, and the same portions are simply designated with the same reference numerals and signs.

In the above manufacturing method, it is assumed that the cross section of the outer peripheral face of the crimp formation region 78 in the external terminal 70 has the polygon (pentagon) of the same dimensions (diameter) in the front-back direction. In contrast, in the present embodiment, as shown in a pre-crimping workpiece 100 of FIG. 7, a crimp formation region 78 of an external terminal 70 is formed such that a large-diameter portion T1 having a diameter larger than the other portions is formed at the center or close to the center of the crimp formation region 78 in the front-back direction (left-right direction in FIG. 7). It should be noted that FIG. 7 shows the degree of the large diameter exaggeratedly. Specifically, in the crimp formation region 78 (which includes a width W1 of the dies 501, 502) of the external terminal 70, an overlapping portion which overlaps with a rear end 55 of a lead shaft member 51 inserted into an attachment hole 72 in the direction of an axis line G includes the large-diameter portion T1 having the diameter larger than the other portions at the center or close to the center of the overlapping portion W1 (width W1 of dies 501, 502 in FIG. 7) in the front-back direction. The crimp formation region 78 has an outer diameter formed in an arc shape in a plane section through the axis line G such that the diameter (outer diameter) is reduced gradually from the large-diameter portion T1 toward each end in the front-back direction (left-right direction in FIG. 7) of the crimp formation region 78. Thus, while the cross section of the outer peripheral face of the crimp formation region 78 before the crimping has a polygonal shape similarly to that described in the manufacturing method of FIG. 1 to FIG. 4, the crimp formation region 78 includes the large-diameter portion T1 thicker than the other portions (close to each end) at the center or close to the center thereof in the front-back direction.

As shown, such a pre-crimping workpiece 100 is positioned such that the outer peripheral face of the crimp formation region 78 is sandwiched between the dies 501 and 502 having two-part (pair) split crimping blades attached to a press apparatus (not shown) for crimping, so that the center (the portion close to the center) of the respective dies 501, 502 in the width W1 direction is located at the large-diameter portion T1 at the center or close to the center of the crimp formation region 78. The front-back direction (W1 direction) of shaping portions 503 and 505 in the dies 501 and 502 is parallel to the axis line G. As shown in FIG. 8, the dies 501 and 502 press and crimp the crimp formation region 78. This round crimps the crimp formation region 78 to shape the outer peripheral face from the pentagon in cross section shown in the left diagram of FIG. 4 into a form close to a circle as shown in the right diagram of FIG. 4 to provide a crimped portion 79, thereby fixing the outer terminal 70 to the rear end 55 of the shaft member 51. In the present embodiment, however, in the crimp formation region 78 of the external terminal 70, the overlapping portion (W1) which overlaps with the rear end 55 of the lead shaft member 51 in the axis line G direction includes the large-diameter portion T1 having the diameter larger than the other portions at the center or close to the center thereof in the front-back direction. Thus, in the crimping step, the outer peripheral face of the crimp formation region 78 is crimped with the maximum compress force applied to the large-diameter portion T1 at the center or close to the center. This causes the portion near the large-diameter portion T1 to be parallel to the axis line G in the front-back direction since the portion conforms to the shaping portions 503 and 505 of the dies 501 and 502 as shown in FIG. 8.

Thus, in the present embodiment, the load from the crimping can be applied locally to the large-diameter portion T1, that portion can be deformed more than the other portions. Since this can significantly increase the fixing force from the crimping of the lead shaft member 51 and the external terminal 70 locally at the portion (the large-diameter portion T1 before the crimping), stable electrical connection can be made between them. In addition, since the diameter (outer diameter) is reduced gradually from the large-diameter portion T1 toward each end in the front-back direction of the crimp formation region 78 as described above in the present embodiment, problems such as plating breaks or the like in the surface are effectively avoided. In the present embodiment, the cross section of the crimped portion has the similar configuration to that shown in the right diagram of FIG. 4. Specifically, the two-part (pair) split dies 501 and 502 have the shaping portions 503 and 505 of semicircular shape in cross section, for example, and when the die is closed, the shaping portions 503 and 505 compress and plastically deform the crimp formation region 78 to provide a generally circular shape.

Figure 7:
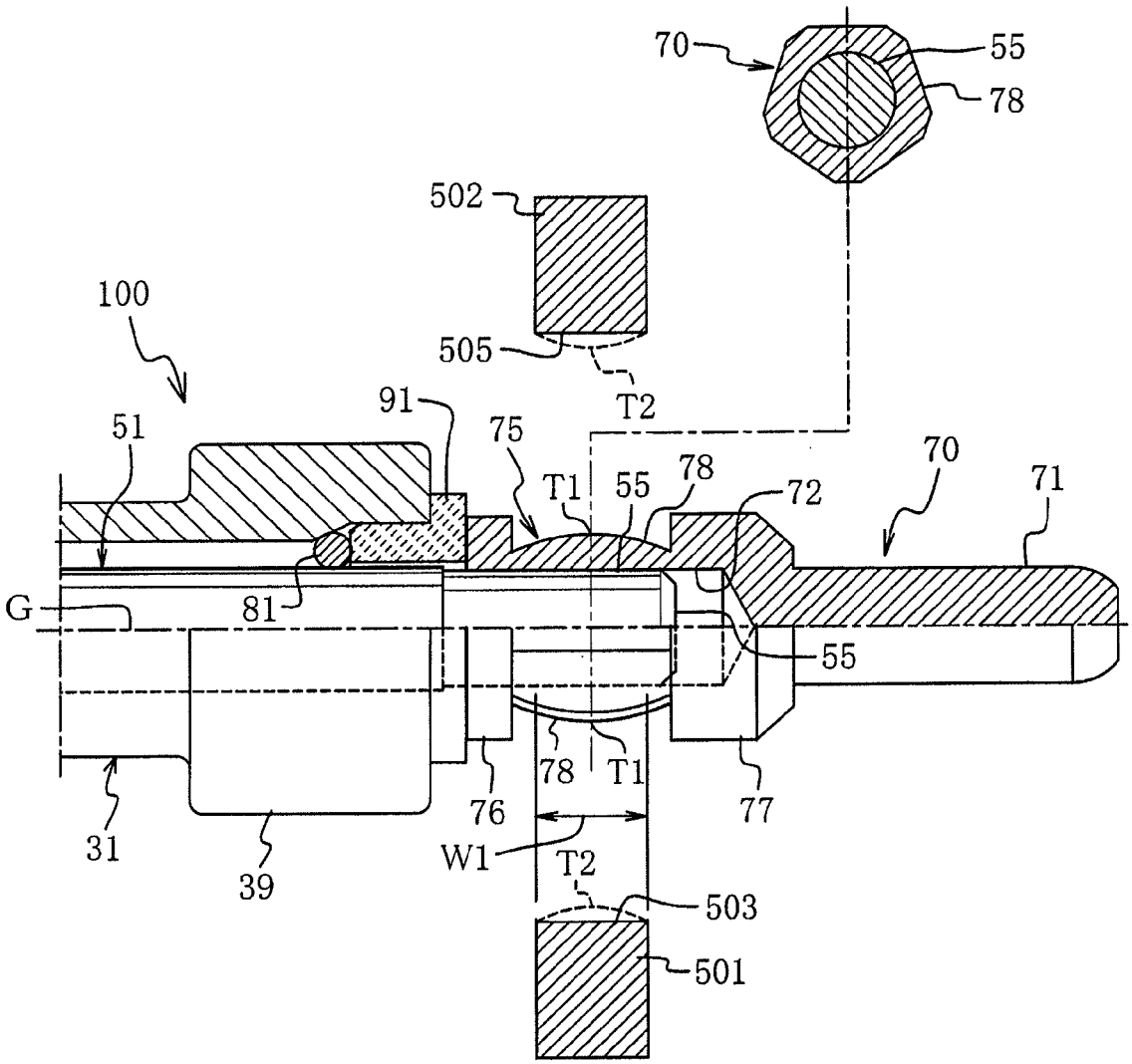
FIG. 7 is a semi-section view showing main portions of a glow plug (pre-crimping workpiece) before an external terminal is crimped by a die for crimping in an improvement of the manufacturing method of the present invention.
Figure 8:
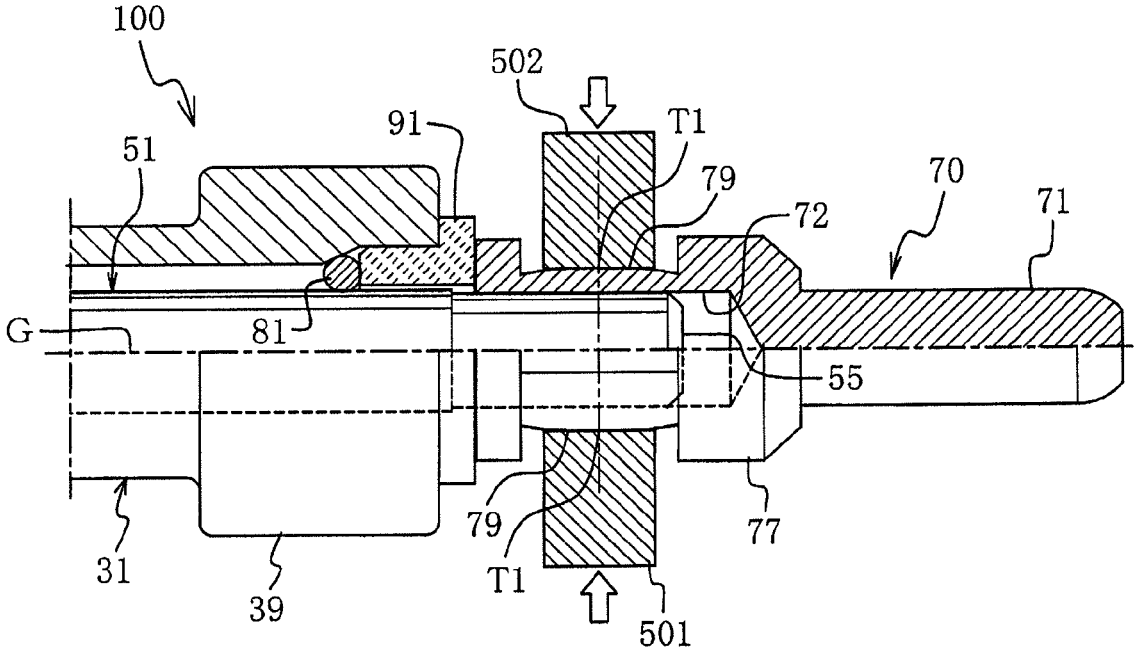
FIG. 8 is a semi-section view showing the main portions of the glow plug after the crimping is finished in FIG. 7.

While the shaping portions 503 and 505 in the dies 501 and 502 are parallel to the axis line G in the front-back direction in the present example, the shaping portions 503 and 505 may be formed to be convex toward the outer peripheral face of the crimp formation region 78 such that the convex has a peak portion T2 at the center or closer to the center of the shaping portion in the front-back direction (width W1 direction) as shown by broken lines in FIG. 7. This can concentratedly crimp the portion near the large-diameter portion T1 at the center or close to the center of the outer peripheral face of the crimp formation region 78 with a larger force. When the shaping portions 503 and 505 of the dies 501 and 502 are formed to be convex such that the convex has the peak portion T2 at the center or closer to the center thereof in the front-back direction in this manner, the convex portion is preferably gradually inclined toward each end of the shaping portions 503 and 505 in the front-back direction, that is, the internal diameter of the shaping portion is gradually increased when the die is closed.

Figure 9:
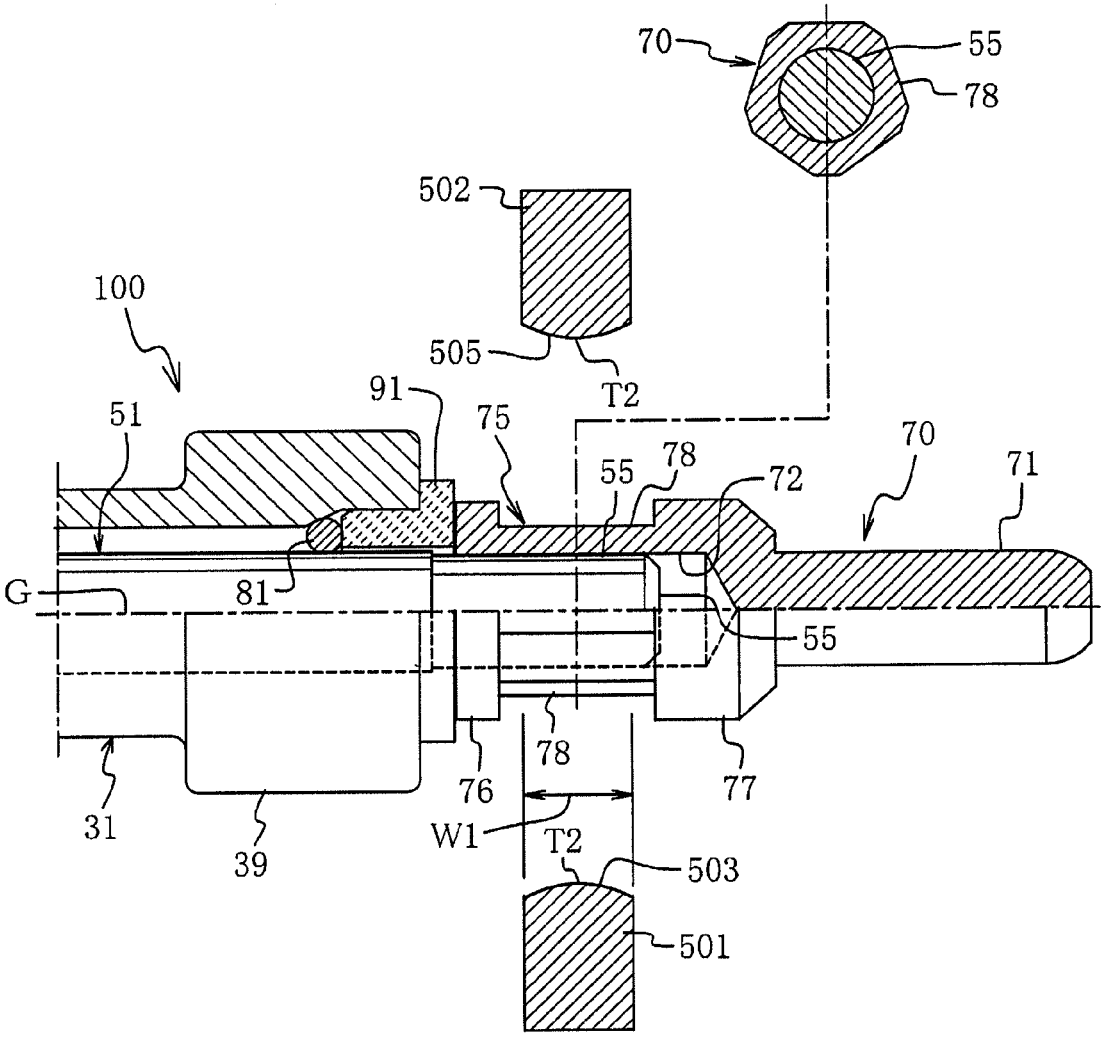
FIG. 9 is a semi-section view showing main portions of a glow plug (pre-crimping workpiece) before an external terminal is crimped by a die for crimping in a modification of the manufacturing method shown in FIG. 7 and FIG. 8.
Figure 10:
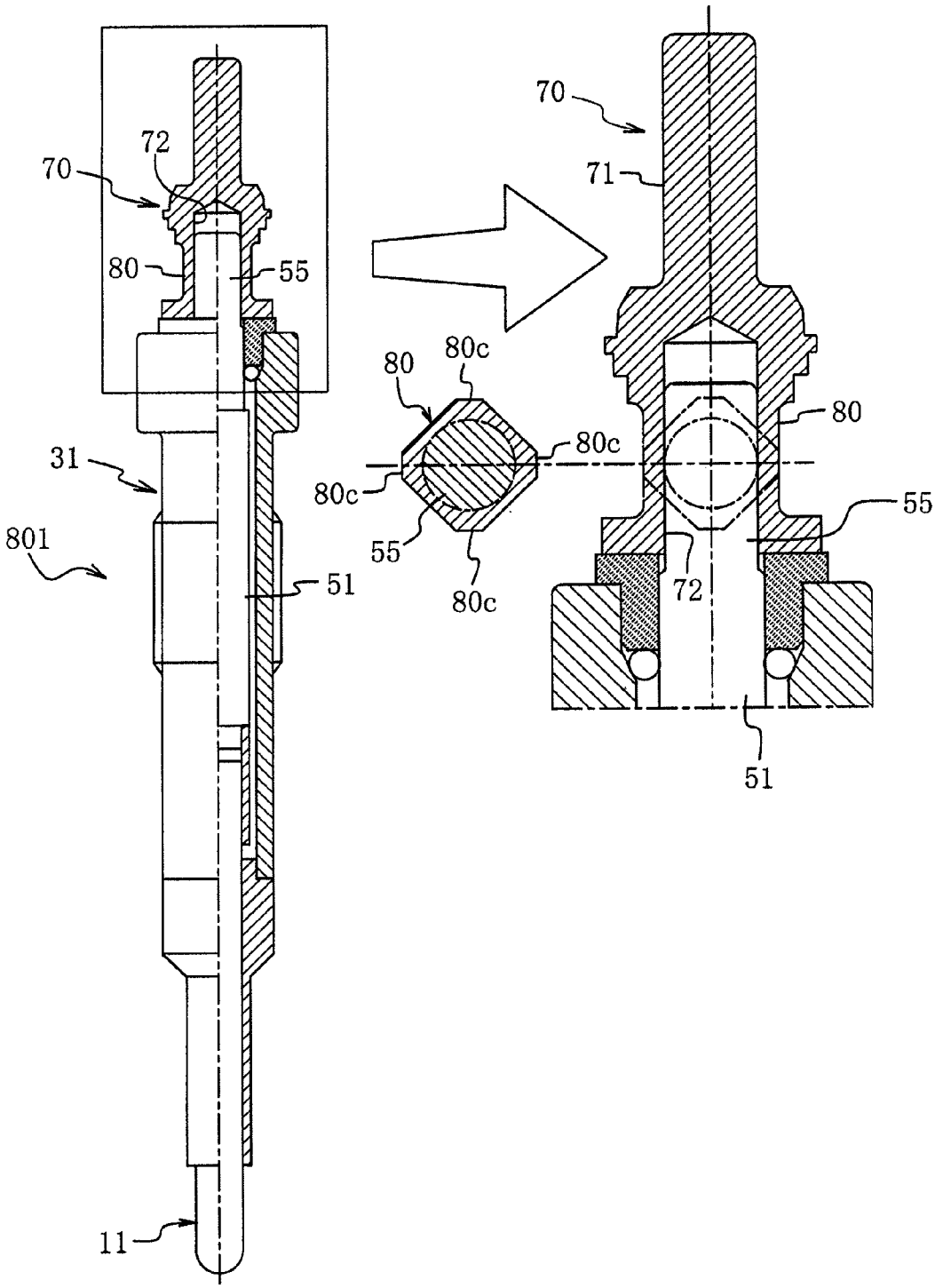
FIG. 10 is a semi-section view showing the front of a conventional glow plug, and an enlarged view showing main portions of the present invention including the external terminal.
Figure 11:
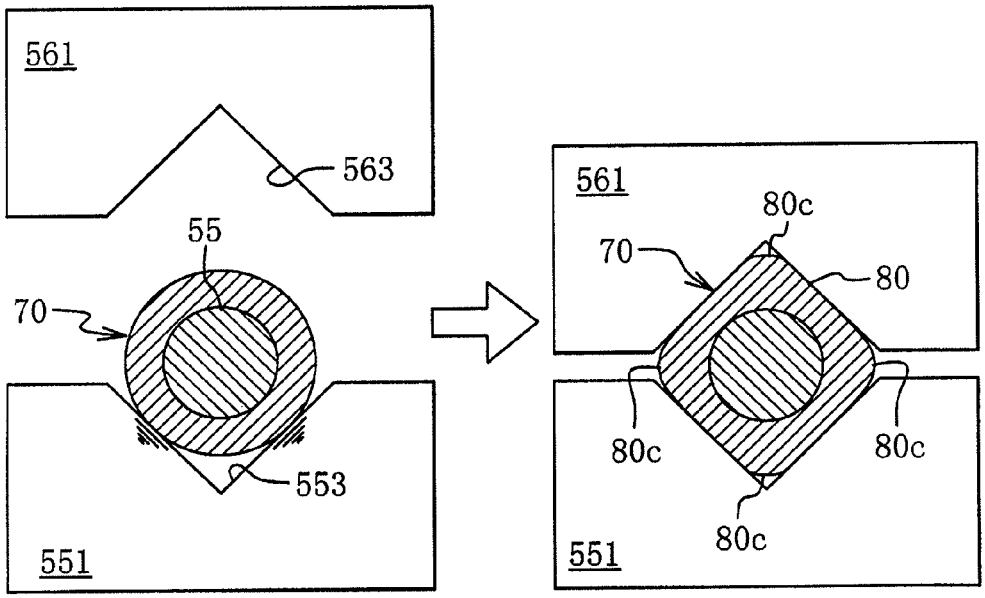
FIG. 11 is a cross section view for explaining a crimping step of an external terminal in the conventional glow plug.

As understood from the foregoing, to apply the large load from the crimping locally to part of the outer peripheral face of the crimp formation region 78, the crimp formation region 78 in the external terminal 70 may be a polygon (pentagon) in which the cross section of the outer peripheral face has the same dimensions (diameter) in the front-back direction as shown in FIG. 9. Specifically, as shown in FIG. 9, it may be essential only that the shaping portions 503 and 505 of the dies 501 and 502 should be formed to be convex to have a peak portion T2 at the center or close to the center thereof in the front-back direction as described above. In this case, however, the shaping portions 503 and 505 of the dies 501 and 502 are preferably formed to be convex toward the outer peripheral face of the crimp formation region 78 such that the convex has the peak portion T2 facing the center or close to the center of the overlapping portion in the front-back direction, in which the overlapping portion overlaps with the rear end 55 of the lead shaft member 51 inserted into the attachment hole 72 in the axis line G direction as shown in FIG. 9. Since the crimping is performed in this state, the portion of the outer peripheral face of the crimp formation region 78 that is associated with the peak portions T2 of the shaping portions 503 and 505 is locally crimped with a large force.

The position of the crimp formation region formed in the external terminal and the dimensions of thereof in the front-back direction in the present invention may be defined appropriately in response to the requirements such as the strength with which the external terminal should be fixed to the shaft member by the crimping. The glow plug to which the present invention is embodied is not limited to a plug including the ceramic heater as the heater element but may be widely applied to various types of glow plugs as long as the configuration of the present invention is used.

DESCRIPTION OF REFERENCE NUMERALS

11 heater element
31 body
51 lead shaft member
55 rear end of lead shaft member
70 external terminal
72 attachment hole
78 crimp formation region
79 crimped portion
101 glow plug
501, 502, 511 to 514 die
503, 505 shaping portion
T1 large-diameter portion
T2 peak portion

The invention claimed is:

1. A glow plug having a configuration in which a heater element generating heat upon supply of electric current thereto is positioned frontward or at a leading end of a tubular body, one of electrodes of the heater element is electrically connected to a metallic lead shaft member positioned inside the body and rearward with respect to the heater element, a rear end of the lead shaft member is inserted into an attachment hole opened at a leading end side of an external terminal having a plating layer thereon, and the external terminal is crimped to be fixed to the rear end of the lead shaft member, characterized in that the external terminal is crimped to form a plastically deformed crimp portion so that an outer peripheral face thereof in cross section is shaped into a form close to a circle from a polygon shape before crimping, whereby the external terminal is fixed to the rear end of the lead shaft member, the crimp portion has an outer peripheral face close to a circle in cross section and said plating layer at the crimp portion is resistant to plating breaks and peeling.

2. A method of manufacturing a glow plug having a configuration in which a heater element generating heat upon supply of electric current thereto is positioned frontward or at a leading end of a tubular body, one of electrodes of the heater element is electrically connected to a metallic lead shaft member positioned inside the body and rearward with respect to the heater element, a rear end of the lead shaft member is inserted into an attachment hole opened at a leading end side of an external terminal, and the external terminal is fixed to the rear end of the lead shaft member, the method comprising a step of crimping the external terminal to fix the external terminal to the rear end of the lead shaft member after inserting the rear end of the lead shaft member into the attachment hole of the external terminal, an outer peripheral face of a crimp formation region of the external terminal before the crimping step being formed into a polygon in cross section, and characterized in that, in the crimping step, the outer peripheral face of the crimp formation region in cross section is shaped into a form close to a circle from the polygon shaped before the crimping step.

3. The method of manufacturing a glow plug according to claim 2, characterized in that a die used in the crimping step is a two-part split die formed such that a shaping portion thereof defines a circular shape when the die is closed, and that the outer peripheral face of the crimp formation region of the external terminal is formed into a polygon having an odd number of corners in cross section.

4. The method of manufacturing a glow plug according to claim 2, characterized in that, in the crimp formation region of the external terminal, an overlapping portion overlapping with the rear end of the lead shaft member inserted into the attachment hole in an axis line direction has a large-diameter portion having a diameter larger than other portions at the center or close to the center of the overlapping portion in a front-back direction.

5. The method of manufacturing a glow plug according to claim 2, characterized in that a shaping portion of a die used in the crimping step for crimping the outer peripheral face of the crimp formation region is formed to be convex toward the outer peripheral face of the crimp formation region such that the convex has a peak portion at the center or close to the center of the shaping portion in a front-back direction.

6. The method of manufacturing a glow plug according to claim 2, characterized in that a shaping portion of a die used in the crimping step for crimping the outer peripheral face of the crimp formation region is formed to be convex toward the outer peripheral face of the crimp formation region such that the convex has a peak portion facing the center or close to the center of an overlapping portion in the crimp formation region of the external terminal, the overlapping portion overlapping with the rear end of the lead shaft member inserted into the attachment hole of the external terminal in an axis line direction.

* * * * *